United States Patent [19]

Brewill

[11] 4,385,722

[45] May 31, 1983

[54] PACKAGING OF ARTICLES

[75] Inventor: Arthur D. Brewill, Nottingham, England

[73] Assignee: Metal Closures Venus Packaging Limited, Ilkeston, England

[21] Appl. No.: 259,690

[22] Filed: May 1, 1981

[30] Foreign Application Priority Data

May 2, 1980 [GB] United Kingdom ..... 8014733
Jun. 21, 1980 [GB] United Kingdom ..... 8020390

[51] Int. Cl.[3] ..... B65D 33/20; B65D 33/36; B65D 33/06; B65D 85/62

[52] U.S. Cl. ..... 229/62; 206/45.34; 206/554; 206/806; 229/54 R; 150/1; 53/452; 53/459

[58] Field of Search ..... 206/554, 45.34, 806; 229/62, 54 R, 48 S, 48 B; 150/1; 53/452, 459

[56] References Cited

U.S. PATENT DOCUMENTS

| | | | |
|---|---|---|---|
| 2,873,566 | 2/1959 | Sylvester et al. | 150/1 |
| 2,962,157 | 11/1960 | Meister | 206/554 |
| 3,015,918 | 1/1962 | Schoen | 150/1 |
| 3,098,561 | 7/1963 | Kass | 206/45.34 |
| 3,101,887 | 8/1963 | Kugler | 229/62 |
| 3,181,583 | 5/1965 | Lingenfelter | 229/62 |
| 3,385,428 | 5/1968 | Kugler | 206/554 |
| 3,387,766 | 6/1968 | Kugler | 229/62 |
| 3,670,947 | 6/1972 | Tangredi et al. | 229/62 |
| 4,015,771 | 4/1977 | Sengewald | 229/62 |

*Primary Examiner*—William T. Dixson, Jr.
*Attorney, Agent, or Firm*—Drummond, Nelson & Nissle

[57] ABSTRACT

A package comprising a body for containing the article(s) to be packaged, the body having a first opening closed by closure means movable to permit access into the interior of the body for removal of the article(s) contained within the body and a second opening for permitting insertion of article(s) into the interior of the body.

15 Claims, 10 Drawing Figures

PACKAGING OF ARTICLES

The present invention relates to packaging of articles, in particular a package and method of packaging.

The invention primarily, but not exclusively, relates to packages of sheet plastics material such as bags or envelopes.

Bags or envelopes of plastics material having one open side which in use is closed by a flap have been increasingly used for packaging of articles such as clothes, or literature. The bags have one or more strips of adhesive which secure the flap in its closed position. The provision of strips of adhesive near to the open side of the bag has presented problems as regards filling of the bag since articles presented for insertion into the bag can become adhered to the adhesive strip. This could damage the articles and/or the bag. Accordingly, to avoid this problem it is common practice to cover each adhesive strip with a cover strip which may be removed after filling of the bag to expose the adhesive strip and enable the flap to be held in its closed position. Unfortunately, provision of a cover strip creates other problems which are undesirable. For instance, the presence of the cover strip makes the filling of the bags labour intensive since personnel are required to manually remove the strip and close the flap after filling. This obviously is a limiting factor in the speed of filling of bags and also increases the cost of packaging.

It is a general aim of the present invention to provide a package and method of packaging which avoids, or substantially reduces the above problems.

According to one aspect of the present invention there is provided a package comprising a body for containing the article(s) to be packaged, the body having a first opening closed by closure means movable to permit access into the interior of the body for removal of the article(s) contained within the body and a second opening for permitting insertion of article(s) into the interior of the body.

Preferably, the body is formed by a pair of opposed layers of plastics material such as polypropylene or polyethylene joined together to define peripheral edges of the body and said first and second openings. Preferably first and second layers of said pair of layers are joined together to define opposed sides of the body with the first opening being preferably formed at one end of the body and the second opening at the other end of the body.

Conveniently, the first opening is defined by one end edge of the first layer and the surface of the second layer, the second layer being extended to define the closure means in the form of a flap. The flap is folded to close the first opening and overlie the first layer, the adhesive being provided between the flap and the first layer for securing the flap thereto. The adhesive is preferably of the type enabling the flap to be repeatedly lifted from and re-adhered to the first layer. The adhesive may be solvent based or may be a hot melt adhesive. Preferably, the flap is also secured in the closed position by welding say the end edges of the flap to the first and second layers.

The second opening may be defined by opposed end edges of the first and second layers or by an end edge of one layer and the surface of the other layer or by a slit or aperture formed in one of said layers.

According to another aspect of the present invention there is provided a method of packaging articles including inserting articles into a package defined above through said second opening and permanently closing said second opening. In the case where the body is formed from said pair of layers of plastics material, the second opening is closed preferably by fusion of the first and second layers to one another to form a bag or envelope having a single opening closed by a flap.

According to another aspect of the invention there is provided a bag or envelope formed from a package as defined above.

Other aspects of the invention are described below with reference to the accompanying drawings, in which.

Figures 1, 4, 5:
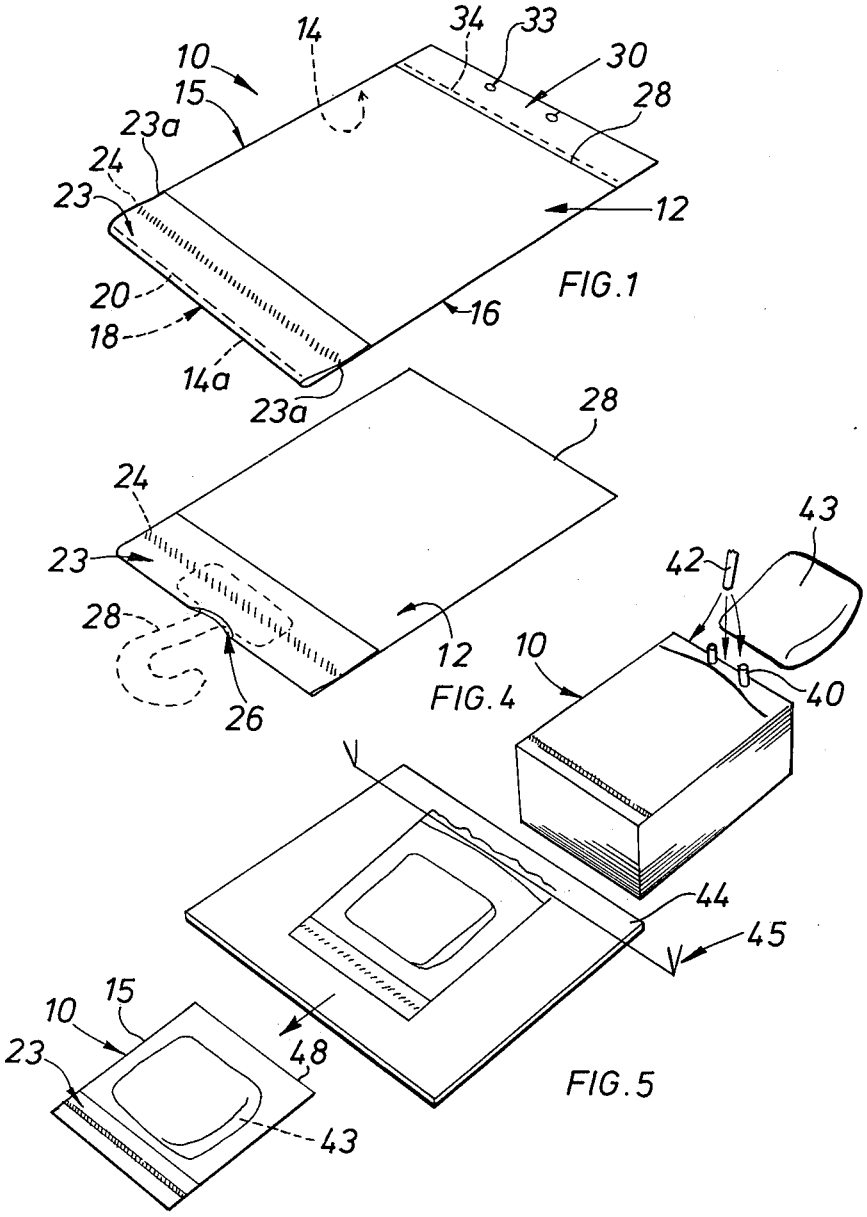
FIG. 1 is a schematic perspective view of a package according to the present invention.
FIG. 4 is a schematic perspective view of another package according to the present invention.
FIG. 5 is a schematic perspective view of a loading machine for filling packages with articles.
Figure 2:
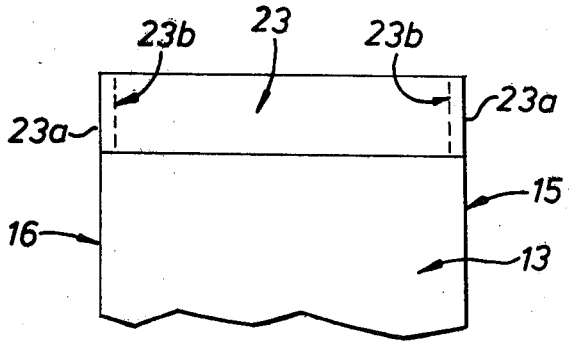
FIGS. 2 and 3 show modifications of the flap closure shown in FIG. 1.
Figure 3:
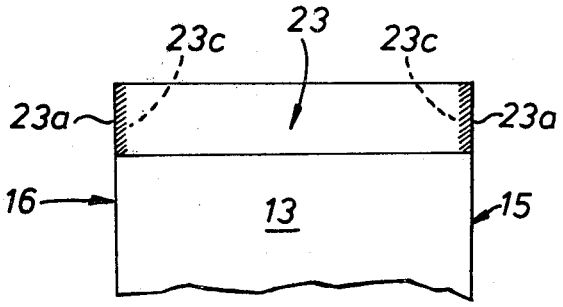

Referring initially to FIGS. 1 to 4 there is shown a package 10 having a body 12 for containing articles to be packaged. The body 12 is formed from two layers 13, 14 of plastics material, such as polypropylene or polyethylene which are seamed together to formed opposed sides 15, 16 of the body. At one end of the body 12 there is formed a first opening 18 which is defined by an end edge 20 of the first layer and the surface **14*a* of the second layer. The second layer 14 is extended to define a flap 23 which is folded to overlie the first layer to close the opening. A strip of adhesive 24 is provided for securing the flap 23** to the first layer.

In order to reduce the likelihood of the flap being opened accidentally and thus facilitate handling prior to and during packaging the end edges **23*a* of the flap are secured to layers 13, 14 by being incorporated in the seams forming sides 15, 16**.

The welding of edges **23*a* to layers 13, 14 is however formed in such a way that on lifting of the flap 23 the weld at edges 23*a* is broken to release the flap. Such a weld may be formed by adjusting the welding/severing device (described below) to have a lower temperature in the region of edges 23*a*** so as to produce a weak weld in that region.

An alternate way of sealing the end edges **23*a* of the flap is to permanently weld the end edges 23*a* to layers 13, 14 and to provide adjacent each edge 23*a* a line of perforations 23*b* (FIG. 2) which enable the flap end edges to be separated from the layers 13, 14** on lifting of the flap.

A further alternative (FIG. 3) is to provide a coating of a release material **23*c* in the region of edges 23*a*, between flap 23 and layer 13, the release material being such that it prevents or inhibits welding of edges 23*a* to layers 13, 14 during the welding/severing operation. Accordingly end edges 23*a* are either separate from layers 13, 14 or are secured thereto by weak welding which breaks easily on lifting of the flap 23. The release material is conveniently applied to layer 13** and/or flap 23 by conventional printing techniques, the release material for instance being a printing lacquer.

A cut away portion 26 may be provided for permitting a hook member 28 to be inserted between the flap 23 and first layer 13. The hook member 28 which is conveniently formed from a stiff plastics material overlies a portion of the adhesive strip and is adhered thereto to retain it in position. If desired the cut away portion 26 may be replaced by a slit. Additionally, apertures may be formed through the flap and layers 13, 14 in order to provide an opening for hanging the bag on a hook or to provide a handle for carrying the bag.

As shown in FIG. 1 the second opening is defined by edge 28 of the first layer and surface 14*a* of the second layer, the second layer being extended to define a flap 30. Flap 30 is provided with apertures 32 for supporting the package on a wire wicket from which the package may be torn. To assist tearing of the package from the wicket slits 33 and/or a line of perforations 34 may be provided.

Accordingly, a packaging machine 50 as schematically illustrated in FIG. 5 may be supplied with packages according to the present invention for packaging articles automatically. Thus a stack of packages 10 are supported on a wicket 40 and the upper most package on the stack is inflated by air blown from a nozzle 42. An article 43 is then inserted into the inflated package and the package is then pulled away from the wicket 40 along a table surface 44. Pulling of the package results in tearing of a flap 30 and the freed package is then pulled to a heat sealing means 45 which fuses the first and second layers together to form a seam 48 extending between sides 15, 16.

Accordingly a bag is form having seamed sides 15, 16 and a bottom formed by a seam 48.

In FIG. 4 the second opening is defined by end edges of both the first and second layers. This embodiment is primarily intended for packaging by personnel wherein the article is manually loaded via the second opening and is then presented to a fusion device for fusing the end edges of the first and second layers together to form a seamed bottom for the thus formed bag.

It will be appreciated that the embodiment in FIG. 4 may be further modified to permit stacking on a wicket in the same manner as the embodiment of FIG. 1 by the provision of apertures and lines of weakness to enable the package to be torn from the wicket, such as a line of perforations running parallel to the end edges of the first and second layers.

Figure 6:
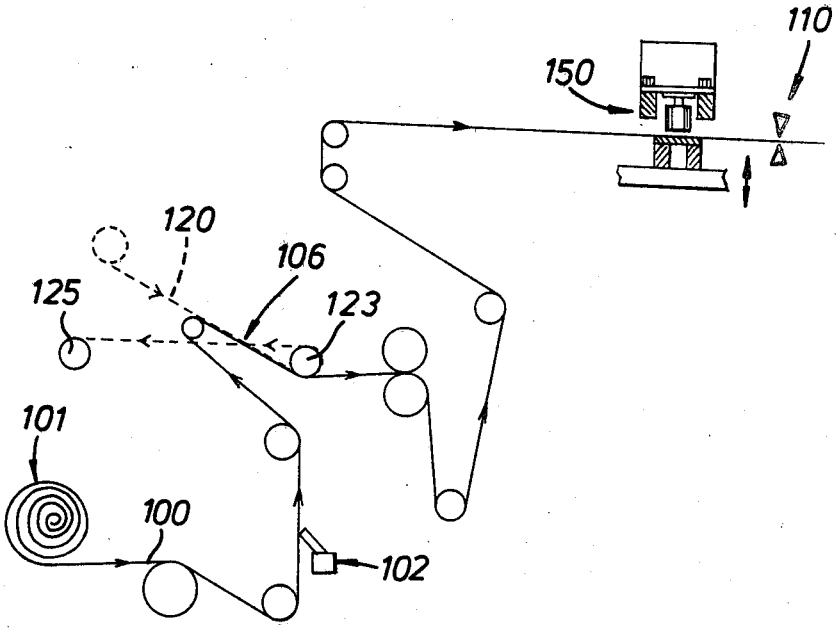
FIG. 6 is a schematic representation of apparatus for forming a package according to the present invention.
Figure 7:
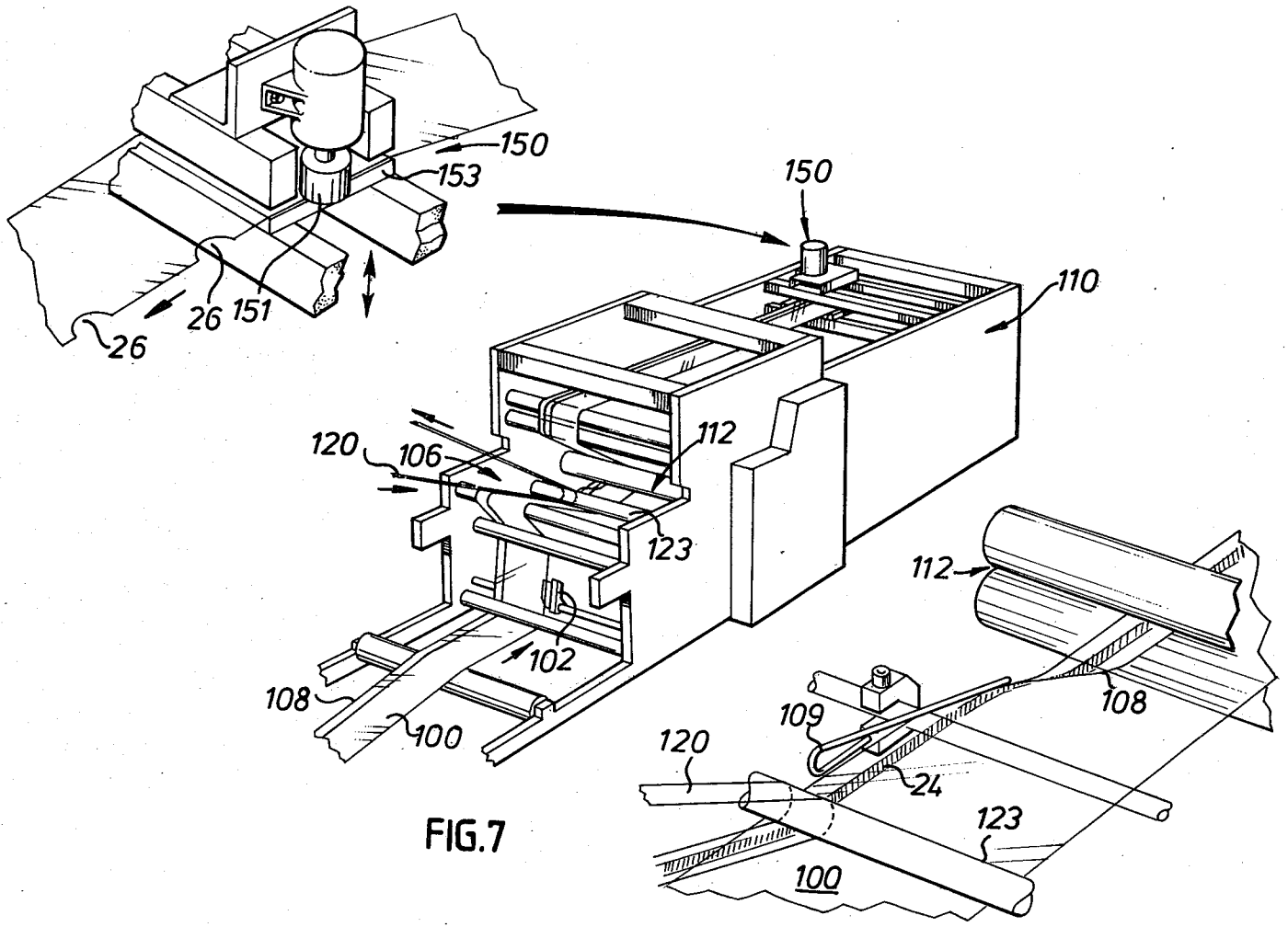
FIG. 7 is a perspective view of apparatus for forming packages according to the present invention.

A method of producing packages according to the present invention is exemplified with reference to FIGS. 6 and 7.

Plastic film 100 is fed from a roll of film 101 to a folding guide which produces a 'J' fold. The 'J' folded film is then presented to a cutting device 102 which either produces a single cut to define two superimposed layers of unequal width, the lower layer having a marginal portion projecting from one side of the upper layer for eventually forming the flap 30 of the FIG. 4 embodiment; or produces a pair of spaced cuts to define two superimposed layers of unequal width, the lower layer having marginal portions projecting either side of the upper layer, which marginal portions will eventually form flaps 23, 30 of the packages shown in FIG. 1.

The superimposed layers are then fed to an adhesive application station 106. At the station 106 is an adhesive carrying tape 120 is presented to and brought into contact with the upper layer of film. The tape 120 has a layer of adhesive which is releasably attached thereto. The tape and film are fed under a roller 123 under tension so as to ensure pressure contact between the adhesive and the film. Immediately after roller 123 the tape is separated from the film by being directed to a reel winder 125 thus leaving a strip of adhesive on the upper layer of film.

As illustrated the tape 123 is of finite length, it being unwound from one reel and wound onto another reel. It is envisaged that as an alternative, the tape may be in the form of a continuous loop which is moved in succession between an adhesive applicator (not shown) whereat adhesive is applied to the tape, the tape coated with adhesive then passing to the adhesive application or transfer station 106. The tape, without adhesive is then returned to the adhesive applicator station to receive a further coating of adhesive.

Subsequently, the marginal portion 108 (which will eventually form flap 23) is folded by a guide 109 to overlie the upper layer of film and the two layers of film together with the folded marginal portion 108 are fed between a pair of nip rollers 112 which ensure adhesion between the folded marginal portion 108 and the upper layer of film.

The film is then fed to a welding/severing device 110 of conventional construction whereat individual packages are formed by creating lateral seams across the film which serve to weld the upper and lower layers of film together and separation of adjacent packages.

Conveniently, at the welding/severing station, a cutting device 150 is provided for forming cut away portions 26. The cutting device 150 includes a cutting blade 151 which is formed at the end of a cylindrical drum. The blade is continuously rotated. A pressure block 153, made of a material softer than the blade so as not to cause damage is positioned below the blade. A suitable material is a suitable rubber or polytetrafluoreothylene. The film is fed between the block 153 and the blade 151 and the block is mounted on a frame which carries a lifting block (not shown) for presenting the film to the welding means of the welding device. Accordingly, block 153 is lifted in sychronism with the welding operation and on lifting of block 153, the film is pressed onto blade 151 to form a cut-away portion 26.

Other perforations, slits etc. may be formed at any convenient location by conventional techniques.

The tape 123 may be provided with adhesive by using an operation as illustrated and described in our U.K. Patent Application No. 7901255 to which reference should be made.

Figures 8, 9, 10:
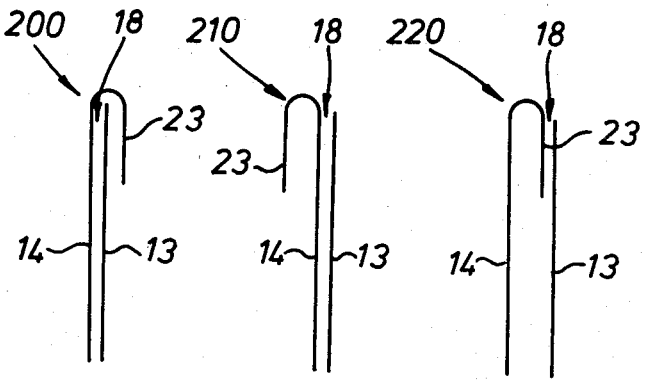
FIGS. 8 to 10 are respectively schematic cross-sectional views of further embodiments according to the present invention.

Alternative embodiments of packages 200, 210 and 220 according to the present invention are illustrated in FIGS. 8 to 10.

The packages 200, 210, 220 illustrated are basically the same construction as those illustrated in FIGS. 1 and 4 and similar parts are designated by similar reference numerals. The main difference in construction resides in the omission of the adhesive strip 24, the positioning of the flap 23 and the permanently welding of edges 23*a* to layers 13, 14. In all three embodiments illustrated in FIGS. 6 to 8 the end edges 23*a* of the flap are permanently secured to layers 13, 14 by being incorporated in the seams forming sides 15, 16. In the embodiment of FIG. 8 the flap 23 overlies the first opening 18, in FIG. 9 the flap 23 is contained within opening 18, and in FIG. 10 the flap 23 extends along the outer surface of layer 14. In these embodiments the flap 23 is retained in its closed position solely by its end edges being secured to layers 13, 14. Such packages could be produced by the method described above wherein the adhesive application station 106 would be omitted.

What is claimed is:

1. A package comprising a body for containing the article(s) to be packaged, the body having a first opening closed by closure means movable to permit access into the interior of the body for removal of the article(s) contained within the body and a second opening for permitting insertion of article(s) into the interior of the body, the body being formed by a pair of opposed layers of plastics material joined together to define peripheral edges of the body and said first and second openings, the first opening being defined by one end edge of a first of said layers and the surface of the second layer, the second layer being extended to define the closure means in the form of a flap, the end edges of the flap being secured by welding to the first and second layers, a coating of a release material being provided between the flap and first layer in the region of the end edges of the flap in order to inhibit welding of the flap end edges to the first and second layers so that on lifting of the flap the flap end edges separate from the first and second layers.

2. A package according to claim 1 wherein adhesive is provided between the flap and first layer in order to secure the flap in a closed position.

3. A package according to claim 1 or 2 including hanging means to permit the package to be hung from a support.

4. A package according to claim 3 wherein the hanging means comprises a hook member having a base portion located between the flap and the first layer and a hook portion protruding beyond the flap.

5. A package according to claim 3 wherein the hanging means comprises an opening extending through the flap, the first and second layers to provide an opening for hanging the package on a support or a handle for carrying the package.

6. A package according to any of claims 1, 2, 3, 4 or 5 wherein the second opening is defined by an end edge of one of said layers and the surface of the other layer, said other layer being extended to define a flap extending beyond the second opening.

7. A package according to claim 6 wherein the flap extending beyond the second opening is provided with openings to enable the package to be stacked on a wicket.

8. A package according to any of claims 1, 2, 3, 4 or 5 wherein the second opening is defined by opposed end edges of both of said layers.

9. A package according to claim 8 wherein the package includes openings adjacent the second opening to enable the package to be stacked on a wicket.

10. A package according to claim 7 or 9 wherein lines of weakness are formed in the package to facilitate tearing of the package from the wicket.

11. A method of producing a package including the steps of forming a pair of superimposed layers of plastics material so that a marginal side portion of one layer protrudes beyond a side edge of the other layer, applying a coating of release material to one of the superimposed layers, presenting the superimposed layers to a folding station whereat the marginal side portion is folded to overlie one of the layers such that the coating of release material is between the layer and overlain marginal side portion, and welding and severing the superimposed layers across their width to produce the package; the welding partially securing the overlain marginal portion to one of the superimposed layers, the coating of release material (a) being applied to one of the superimposed layers at least in the regions to be welded after the marginal side portion is lain over the superimposed layer, and (b) inhibiting welding of the marginal portion to the superimposed layer so that on lifting of the marginal portion the marginal portion readily separates from the superimposed layer.

12. A method of producing a package including forming a pair of superimposed layers of plastics material of different widths so that a marginal side portion of the layer of greater width protrudes beyond a side edge of the narrower layer, presenting the superimposed layers to a folding station whereat the marginal side portion is folded to overlie one of the layers and subsequently presenting the folded superimposed layers to a welding-/severing station whereat the superimposed layers are simultaneously welded and severed across their width to produce the package.

13. A method according to claim 12 wherein prior to folding of the marginal portion a strip of adhesive is applied to the narrower layer so as to retain the folded marginal portion.

14. A method according to claim 13 wherein the adhesive is applied to the narrower layer by a release tape coated with the adhesive, the tape being pressed onto and subsequently peeled off the narrower layer in order to transfer adhesive from the tape to the narrower layer.

15. A method according to claim 14 wherein the release tape is in the form of a continuous loop which passes in succession through the adhesive applicator station whereat adhesive applied to the tape to a transfer location whereat the adhesive is transferred from the tape to the narrower layer, the tape then returning to the adhesive applicator station.

* * * * *